United States Patent [19]

Panaro

[11] 4,367,451

[45] Jan. 4, 1983

[54] FUSIBLE ELEMENT FOR ELECTRIC FUSES AND ELECTRIC FUSE INCLUDING THE ELEMENT

[75] Inventor: Robert J. Panaro, Byfield, Mass.

[73] Assignee: Gould Inc., Rolling Meadows, Ill.

[21] Appl. No.: 177,330

[22] Filed: Aug. 12, 1980

Related U.S. Application Data

[63] Continuation of Ser. No. 39,466, May 16, 1979.

[51] Int. Cl.[3] ..... H01H 85/12

[52] U.S. Cl. ..... 337/160; 337/159; 337/296

[58] Field of Search ..... 337/160, 166, 296, 158, 337/159, 290, 295

[56] References Cited

U.S. PATENT DOCUMENTS 2,809,257 10/1957 Swain ..... 337/296

3,386,062 5/1968 Kozacka et al. ..... 337/160

3,543,209 11/1970 Kozacka ..... 337/159

*Primary Examiner*—Harold Broome

*Attorney, Agent, or Firm*—Frederick A. Goettel, Jr.; Erwin Salzer

[57] ABSTRACT

A fusible element for electric fuses including a core or layer of copper, an outer layer of silver plating, and an M-effect overlay on the silver layer of a low fusing point metal, e.g. tin, capable of severing the current path through the plating of silver and the core of copper by a metal diffusion process.

The M-effect overlay is arranged in spaced relation in regard to the point of the fusible element where the highest temperature prevails to maximize the temperature difference, or temperature gradient, between the M-effect overlay and the hottest point of the fusible element when the latter is carrying current.

4 Claims, 5 Drawing Figures

FUSIBLE ELEMENT FOR ELECTRIC FUSES AND ELECTRIC FUSE INCLUDING THE ELEMENT

This is a continuation of application Ser. No. 39,466, filed May 16, 1979.

BACKGROUND OF THE INVENTION

The invention solves the problem of providing a fusible element for an electric fuse, and an electric fuse, respectively, wherein the heating period required to effect blowing is relatively short, and much shorter than that of fusible elements of copper, or fuses having such elements.

Another object of this invention is to minimize the quantity of silver required to manufacture fusible elements, and thus to greatly increase the cost effectiveness thereof.

The fusible elements according to this invention include silver clad cores of copper. During World War II extensive research work was done in England and Germany with such fusible elements, and their performance was reported to be poor. An entirely different picture arises by adding an M-effect overlay on the layer, or layers, of silver and in adopting the geometry set forth below in greater detail.

SUMMARY OF THE INVENTION

The invention is concerned with a ternary fusible element, i.e. one that involves three interacting metals. One of them is a layer or core of copper of relatively large cross-section. This layer is covered, at least on one side, and preferably on both sides thereof, by a layer, or layers of silver. The layers of copper and silver have a point where the temperature is highest either on account that there is a relatively limited heat flow away from that point, or on account that there is a relatively large heat generation at this point, or on account that there is a combination of both reasons. If the M-effect overlay of the fusible element is arranged in axially spaced relation from the point of highest temperature, alloys of the M-effect overlay and of silver flow from the point where they are initially formed over a surface of silver to the point where the temperature of the fusible element is highest. This results in rapid severing of the current path formed by the layers of silver and copper of the fusible element.

DESCRIPTION OF PREFERRED EMBODIMENTS

Figure 1:
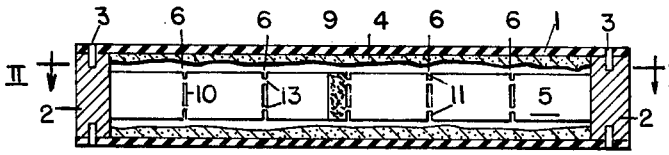
FIG. 1 is a longitudinal section of a fuse embodying this invention including a fusible element embodying this invention, taken along I—I of FIG. 2.
Figure 2:
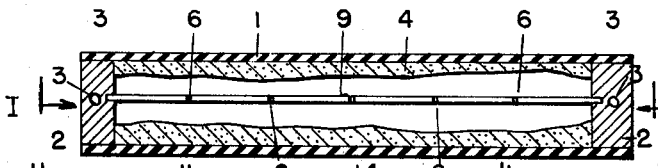
FIG. 2 is partly a section taken along II—II of FIG. 1, and partly an elevation at right angles to that of FIG. 1.
Figure 3:
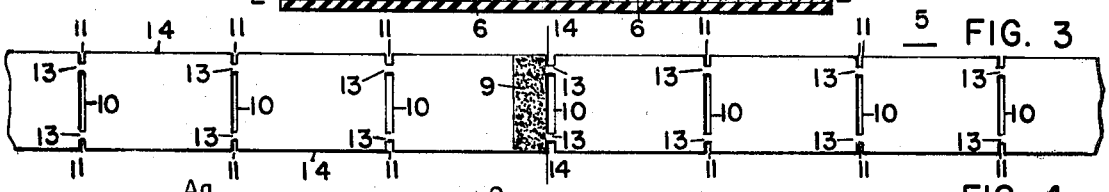
FIG. 3 is a top plan view of a portion of the fusible element shown in FIG. 1 drawn on a larger scale than FIG. 1.
Figure 4:
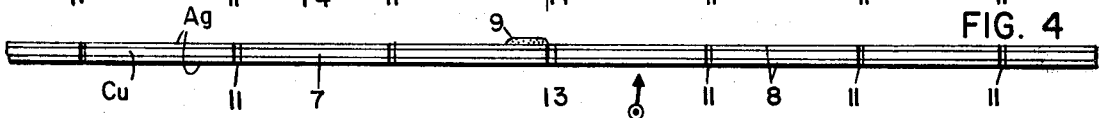
FIG. 4 is a side elevation of the structure shown in FIG. 3.

Referring now to the drawings, numeral 1 has been applied to indicate a tubular casing of an electric insulating material, such as glass-cloth melamine, or glass-cloth polyester. Casing 1 is closed on both ends by electroconductive terminal elements in the form of terminal plugs 2. The latter are affixed by steel pins 3 to casing 1. Casing 1 is filled with an arc-quenching filler 4, preferably quartz sand. Arc-quenching filler 4 fills the entire volume of casing 1, except where occupied by other parts, but has only been shown at its interface with casing 1. Terminals 2 are conductively interconnected by a fusible element generally designated by reference numeral 5. Fusible element 5 has a plurality of points of reduced cross-section 6 which are arranged in series. It comprises a core of copper 7 and one or two outer layers of silver. Reference numeral 9 has been applied to indicate a so-called M-effect overlay whose purpose consists in severing fusible element 5 on occurrence of overloads of excessive magnitude and duration.

Before describing FIGS. 1–4 in greater detail, FIG. 5 will be discussed because it shows best the gist of the present invention.

Three structurally identical fusible elements, each including an M-effect overlay capable of severing by metal interdiffusion the current path formed by the fusible element were subjected to the same current for different lengths of time. The voltage drop across the elements is plotted in FIG. 5 against the duration of current flow. The line Cu refers to a fusible element that consisted of electrolytic copper, the line Ag refers to a fusible element that consisted of pure silver, and the line Cu-Ag consisted of a fusible element that consisted of silver plated copper as shown in FIGS. 1–4.

The fusible element Cu had after a heating period of five minutes a voltage drop a across it and the fusible element Ag had after a heating period of five minutes a voltage drop b across it. This is mainly the result of the higher resistivity of copper compared to of silver, the resistivity of the former at 20° C. being $1.72\times10^{-6}$ ohm/cm and the resistivity of the latter at 20° C. being $1.64\times10^{-6}$ ohm/cm.

Since the temperature coefficient of solid copper is $4.39\times10^{-3}$ per deg.C. and the temperature coefficient of solid silver is $4.42\times10^{-3}$ per deg.C., both curves Cu and Ag should be substantially parallel if the curves Cu and Ag were merely determined by the temperaure of the two metals Cu and Ag. The great difference in the curves Cu and Ag is due to complex metallurgical reactions which need not to be described in detail since they have no immediate bearing upon the present invention. Suffice it to note that the fusible element of copper shows a very slow increase in voltage drop and that it did not clear the circuit after a heating period of 75 minutes. The voltage drop across the fusible element of silver equaled that of the fusible element of copper after a heating period of about 25 minutes. The continued rapid increase in voltage drop across the fusible element of silver resulted in rapid fusion of it and interruption of the current path established by it.

Figure 5:
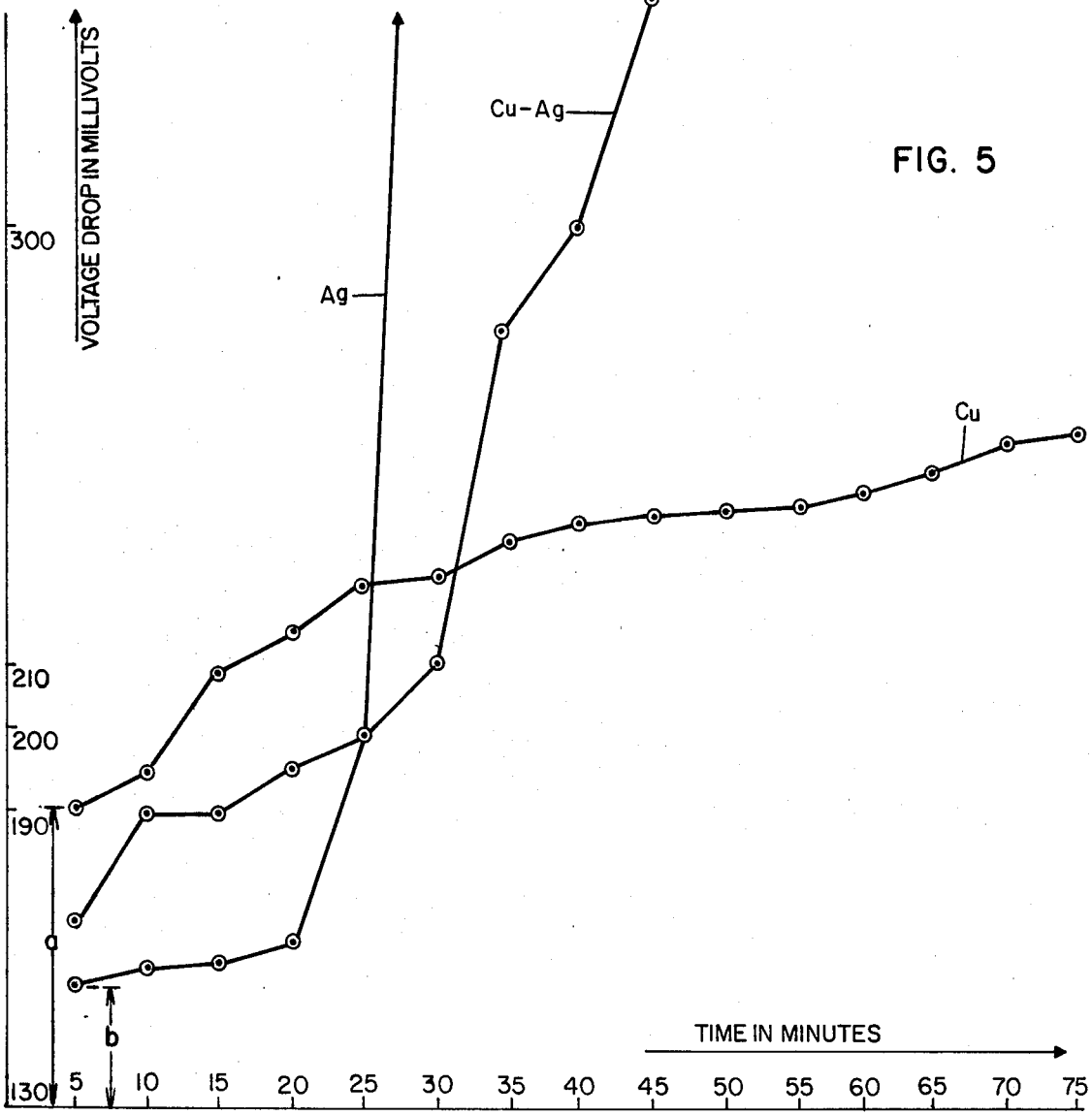
FIG. 5 shows the voltage drop along several fusible elements in terms of millivolts plotted against the time of current flow in the several fusible elements that were identical as far as their geometry is concerned and differed only in regard to their composition. All the elements had identical M-effect overlays.

FIG. 5 is an illustration of the much higher desirability of M-effect fusible elements of silver over M-effect fusible elements of copper.

The curve Cu-Ag refers to an M-effect fusible element, or to a fuse containing an M-effect fusible element, as shown in FIGS. 1–4. It is apparent from FIG.

5 that the performance of such a fusible element, or fuse, is much closer to an Ag than to a Cu fuse. After about a little more than thirty minutes of operation the voltage drop of the Cu-Ag device is equal to that of the Cu device. Thereafter the voltage drop across the Cu-Ag device rises rapidly and results in a fusion of its fusible element, while that of the Cu device rises slowly and fusion of its fusible element occurs only after a time not recorded in FIG. 5, i.e. in excess of 75 minutes.

There are many effects which explain more or less the Cu-Ag curve. The conductivity of the outer layer or layers of silver result in an uneven distribution of current density over the cross-section of fusible element 5, though the thin silver plating of the latter only slightly increases the thickness of the core of copper. The eutectic point of the M-effect metal and silver is lower than the eutectic point of the M-effect metal and copper. This is of importance in regard to the time of initiation of diffusion at the interface between the M-effect metal and the base metal, i.e. silver and copper, respectively. The liquid alloy of the M-effect metal and silver flows much more readily across a surface of silver than across a surface of copper away from its point of origin in the solid state. The affinity of Ag, on the one hand, and Cu, on the other hand, to the oxygen contained in air is very different. This may be expressed by the following equations:

$$2Ag+\tfrac{1}{2}O_2=Ag_2O-6.5\text{ cal}$$

$$Cu+\tfrac{1}{2}O_2=CuO-40.8\text{ cal}$$

Consequently a fusible element of Cu combines more readily with the oxygen of the air than a fusible element of Ag. CuO is a stable compound up to the fusing point of copper. $Ag_2O$ is only stable to 180° C., and is reduced to Ag at higher temperatures.

Tin which is a commonly used M-effect metal has a fusing point of 231.8° C. Binary and ternary alloys of tin also generally used as M-effect overlay metals have even slightly lower melting points than tin. Since, according to the above, $Ag_2O$ is only stable to 180° C., and is reduced at higher temperatures, there is an alloy formation at the interface between tin, or any other low fusing point metal, as long as its fusing point is higher than 180° C., at which temperature $Ag_2O$ reverts into Ag. Such an alloy formation is inhibited by the presence of a CuO layer as clearly shown by the Cu curve of FIG. 5.

Aside from the differences in physics and in chemistry of fusible elements according to this invention from prior art fusible elements, their geometry shown in FIGS. 1–4 is responsible for their particular behavior as will now be explained in connection with FIGS. 1–4.

The ribbon-type fusible element 5 of FIGS. 1 to 4 is electrolytically silver-plated so that the silver-plating covers both its upper surface and its lower surface. The fusible element 5 has a point of reduced cross-section 13,13 where the temperature is highest when the fuse carries current. The M-effect metal 9 is arranged in spaced relation from said point 13,13 of reduced cross-section in a direction longitudinally of said fusible element 5 so as not to cover significantly said point of reduced cross-section 13,13 as long as said M-effect metal 9 is in its solid state. Upon liquefication, the alloy of the M-effect metal 9 and silver flows along a surface of silver to the point 13,13 where a higher or the highest temperature of the fusible element 5 prevails. This attraction is so powerful that it overcomes the attraction of forces of gravity which may be opposed to it.

Fusible elements 5 according to this invention include a point, or rather a line, where the layer of copper 7 and the layer or layers of silver 8 change abruptly from a predetermined minimum value to a predetermined maximum value, or vice versa. The M-effect metal is arranged along the boundary line between the region of minimum value, of maximum value of cross-section, and it covers in the solid state thereof but areas of the fusible element 5 having said predetermined maximum value in cross-section.

As shown in FIGS. 1 to 4, inclusive, both layers 7 and 8 are provided with a plurality of relatively long rectangular perforations 10 extending in transversal direction. Layers 7 and 8 are further provided with pairs of relatively short rectangular perforations 11 each arranged to one of the narrow sides of said relatively long perforations 10, and in alignment with said relatively long perforations 10. Perforations 11 are open at the edges 12 of fusible element 5. Perforations 10 and 11 define therebetween pairs of parallel short and narrow current paths 13. The M-effect metal or overlay 9 is arranged in spaced relation from one of said current paths 13 and has a substantially straight boundary line 14 coextensive with one of the longer sides of one of perforations 10 and extending across the entire width of fusible element 5. This maximizes the heat flow away from said one of said parallel current paths 13 toward overlay 9 because of the relatively large heat absorbing capacity of the latter and thus tends to achieve the desired delay-times in case of overloads of inadmissible duration.

Reference numeral 14 has also been applied to indicate the aforementioned abrupt change from a predetermined maximum to a predetermined minimum cross-section of fusible element 5.

On occurrence of relatively small overloads of inadmissible duration overlay 9 melts and forms an alloy with silver layer 8. This liquid alloy flows to current paths 13 which have a much higher temperature than the aforementioned alloy. Consequently both current paths 13 are rapidly severed by an interdiffusion process at elevated temperatures. Arcs in parallel take the place of current paths 13. But arcs in parallel are unstable and, therefore, one of them will be rapidly extinguished. Now the entire current flow is taken up by one single arc gap, which results in accelerated burnback of fusible element 5.

It will be apparent that in the above described structure the aggregate width of the two current paths 13 is less than the width of the ribbon-type fusible element minus the width of perforations 10.

I claim as my invention:

1. A fusible element including (a) a layer of copper;

(b) a layer of silver affixed to said layer of copper;

(c) said layer of copper and said layer of silver having a point of reduced cross-section where the temperature of said fusible element is relatively high when carrying current;

(d) an overlay of an M-effect metal having a lower fusing point than silver arranged on said layer of silver in axially spaced relation from said point of reduced cross-section;

(e) said layer of copper and said layer of silver having a rectangular relatively long perforation that extends in a direction transversely to the direction of said fusible element;

(f) said layer of copper and said layer of silver having a pair of relatively short perforations that extend in the same direction as said relatively long perforation, each of said pair of relatively short perforations being aligned with and arranged to opposite sides of said relatively long perforation and each of said pair of relatively short perforations being open along the edges of said fusible element;

(g) said relatively long perforation and said pair of relatively short perforations define a pair of parallel current paths therebetween; and (h) the width of said overlay of an M-effect metal extends across the entire width of said fusible element, is bounded on one side thereof by a straight line coextensive with one of the longer sides of said relatively long perforation and substantially exposes as long as in the solid state said pair of parallel current paths.

2. An electric fuse comprising a tubular casing of electric insulating material, a pulverulent arc-quenching filler inside said casing, a pair of terminal elements closing the ends of said casing, an elongated fusible element whose base metal is copper, said fusible element being embedded in said arc-quenching filler and conductively interconnecting said pair of terminal elements wherein (a) said fusible element is of silver-plated copper and has one point of reduced cross-section near the center thereof; and wherein (b) an M-effect causing overlay is arranged above the silver plating immediately adjacent but not extending to said point of reduced cross-section, said overlay extending substantially all the way across said fusible element whereby alloys including three metals are formed when the current path through said fusible element is severed on occurrence of overload currents by said M-effect and whereby the voltage drop versus current characteristic of said fuse in generally rendered steeper than the voltage drop versus current characteristic of any otherwise identical fuse except that the fusible element thereof is of non-silver plated copper.

3. An electric fuse as specified in claim 2 wherein said fusible element is provided with a plurality of serially arranged points of reduced cross-section, each of said plurality of points of reduced cross-section including two parallel current paths separated by an elongated rectangular perforation arranged transversely to said fusible element, the aggregate width of said parallel current paths being less than the width of said fusible element minus the width of said perforation.

4. An electric fuse comprising a tubular casing of electric insulating material, a pulverulent arc-quenching filler inside said casing, a pair of terminal elements closing the ends of said casing, an elongated fusible element whose base metal is copper, said fusible element being embedded in said arc-quenching filler and conductively interconnecting said pair of terminal elements wherein (a) said fusible element is silver-plated and includes a plurality of points of reduced cross-section, one of said plurality of points of reduced cross-section being arranged close to the center of said fusible element;

(b) an overlay of a metal having a lower fusing point than silver arranged on top of the silver-plating and extending all the way across said fusible element, said overlay being arranged immediately adjacent to said one, but spaced from said one of said plurality of points of reduced cross-section whereby alloys including said metal of said overlay, silver and copper are formed when the current path through said fusible element is severed by an overload of excessive duration, and whereby the voltage drop versus current characteristic of said fusible element is caused to be generally steeper than and to intersect the voltage drop versus current characteristic of any otherwise identical fuse wherein the base metal of the fusible element is non-silver plated copper.

* * * * *